US009646730B2

(12) United States Patent
Prosser

(10) Patent No.: US 9,646,730 B2
(45) Date of Patent: May 9, 2017

(54) ULTRA CLEAN CLEANING PROCESS FOR RADIOPHARMACEUTICAL REUSABLE PIGS

(71) Applicant: Rodney Wayne Prosser, Columbia, NJ (US)

(72) Inventor: Rodney Wayne Prosser, Columbia, NJ (US)

(73) Assignee: Nuclear Diagnostic Products Inc., Rockaway, NJ (US)

( * ) Notice: Subject to any disclaimer, the term of this patent is extended or adjusted under 35 U.S.C. 154(b) by 765 days.

(21) Appl. No.: 14/334,697

(22) Filed: Jul. 18, 2014

(65) Prior Publication Data

US 2016/0016680 A1 Jan. 21, 2016

(51) Int. Cl.

| | |
|---|---|
| ***B65B 55/04*** | (2006.01) |
| ***G21F 5/018*** | (2006.01) |
| ***G21F 5/12*** | (2006.01) |
| ***G21F 9/04*** | (2006.01) |
| *G21F 5/015* | (2006.01) |

(52) U.S. Cl.

CPC ..... *G21F 5/12* (2013.01); *B65B 55/04* (2013.01); *G21F 9/04* (2013.01); *G21F 5/015* (2013.01); *G21F 5/018* (2013.01)

(58) Field of Classification Search

CPC . G21F 5/00; G21F 5/015; G21F 5/018; G21F 5/12; G21F 9/00; G21F 9/002; G21F 9/04; A61M 5/1785

USPC ..... 53/426

See application file for complete search history.

(56) References Cited

U.S. PATENT DOCUMENTS

| | | | | |
|---|---|---|---|---|
| 4,869,299 A * | 9/1989 | Handke | ..... | G21F 5/018 141/1 |
| 5,519,931 A * | 5/1996 | Reich | ..... | G21F 5/018 206/365 |
| 5,918,443 A * | 7/1999 | Phillips | ..... | G21F 5/018 206/306 |
| 6,576,918 B1 * | 6/2003 | Fu et al. | ..... | G21F 5/018 206/364 |

(Continued)

FOREIGN PATENT DOCUMENTS

| | | | | |
|---|---|---|---|---|
| WO | WO 02073628 A2 * | 9/2002 | ..... | G21F 5/018 |
| WO | WO 2008117097 A2 * | 10/2008 | ..... | G21F 5/015 |

OTHER PUBLICATIONS

The Incidence of Blood Contamination of Lead Unit Dose Containers With and Without Single-Use Protective Inserts Used with Commercially Prepared Radiopharmaceutical Unit Doses, by Martha W. Pickett, Judith E. Kosegi, Kathleen S. Thomas and Kristen M. Waterstram-Rich, Journal of Nuclear Medicine Technology, vol. 26, No. 3, Sep. 1998, pp. 200-203. 4 pages.

*Primary Examiner* — Stephen F Gerrity
(74) *Attorney, Agent, or Firm* — Arthur L. Lessler

(57) ABSTRACT

A process for cleaning reusable canisters known as pigs which contain radioactive drugs and may contain residual radioactive material and other contaminants. Those pigs that are contaminated with radio-active material are removed from the cleaning process until they have decayed to the background radiation level, cleaned and disinfected. Within a very clean drug preparation area a radioactive drug is inserted into the pig and the pig is placed in a protective outer container. At a treatment site the outer container and pig are delivered to a clean treatment area where the pig is removed from the outer container and the drug is removed from the pig and utilized.

5 Claims, 1 Drawing Sheet

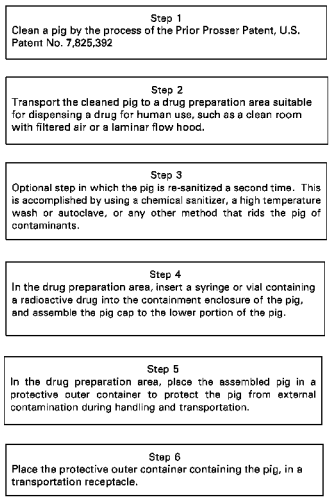

(56) References Cited

U.S. PATENT DOCUMENTS

| | | | | |
|---|---|---|---|---|
| 6,883,222 | B2 * | 4/2005 | Landau | A61L 2/081 53/426 |
| 7,825,392 | B2 | 11/2010 | Prosser | |
| 2002/0195575 | A1 * | 12/2002 | Martin | G21F 5/018 250/506.1 |
| 2004/0084340 | A1 * | 5/2004 | Morelle et al. | A61M 5/1785 206/365 |
| 2008/0306443 | A1 * | 12/2008 | Neer et al. | A61M 5/1785 604/121 |
| 2009/0166370 | A1 * | 7/2009 | De Turk et al. | G21F 5/015 221/8 |
| 2009/0309465 | A1 * | 12/2009 | Quirico et al. | G21F 5/015 312/209 |
| 2011/0178359 | A1 * | 7/2011 | Hirschman et al. | A61M 5/1723 600/4 |
| 2011/0201867 | A1 * | 8/2011 | Wagner | G21F 5/018 600/5 |

* cited by examiner

Step 1
Clean a pig by the process of the Prior Prosser Patent, U.S. Patent No. 7,825,392

Step 2
Transport the cleaned pig to a drug preparation area suitable for dispensing a drug for human use, such as a clean room with filtered air or a laminar flow hood.

Step 3
Optional step in which the pig is re-sanitized a second time. This is accomplished by using a chemical sanitizer, a high temperature wash or autoclave, or any other method that rids the pig of contaminants.

Step 4
In the drug preparation area, insert a syringe or vial containing a radioactive drug into the containment enclosure of the pig, and assemble the pig cap to the lower portion of the pig.

Step 5
In the drug preparation area, place the assembled pig in a protective outer container to protect the pig from external contamination during handling and transportation.

Step 6
Place the protective outer container containing the pig, in a transportation receptacle.

ULTRA CLEAN CLEANING PROCESS FOR RADIOPHARMACEUTICAL REUSABLE PIGS

BACKGROUND OF THE INVENTION

This invention relates to a process that produces ultra clean radiopharmaceutical reusable shipping canisters which are generally referred to as pigs; and more particularly for cleaning pigs utilized for shipping radioactive drugs having relatively short half lives, typically on the order of no more than a few days.

This invention is an improvement on the process disclosed and claimed in U.S. Pat. No. 7,825,392 to Rodney Wayne Prosser, the inventor in the present application, entitled Cleaning Process for Radiopharmaceutical Reusable Pigs; the disclosure and content of which patent (hereafter the "Prior Prosser Patent") is hereby incorporated by reference.

Radioactive drugs are typically shipped by pharmacies to hospitals, clinics and medical offices, frequently for diagnostic purposes; but are at times utilized in "ultra clean" areas where a patient has internal tissues exposed, such as operating rooms, surgical suites or interventional procedure suites; or where the patient is otherwise at a greater than normal risk of contracting an infection. These ultra clean areas have filtered air and other features to minimize the presence of harmful microorganisms. The personnel working in these areas follow strict protocols to reduce the presence of pathogens that can cause harm to patients. These protocols include hand hygiene, gowning procedures, use of sterile gloves, and cleaning procedures for the room and equipment brought into the room. This is done to maintain a sterile or clean operating or procedure field and to greatly reduce the risk of infection.

The radioactive drugs are shipped in pigs, each of which has a lead surround for radiation shielding and an inner chamber that may contain a syringe or vial which is suitable for dispensing an individual dose of a radioactive drug.

The radiopharmaceutical pig typically is a two-part assembly, with an upper portion or cap threadably attached to the lower portion. The structure of a typical pig is shown in FIGS. 2 and 3 of the Prior Prosser Patent and described in the specification thereof, which also describes the manner in which the pig is utilized for transportation of the radioactive drug which is contained in a syringe or vial within the pig.

After the pig is delivered to the utilization site and the syringe or vial is removed and used, the syringe or vial is usually put back in the pig and the spent pig is returned to the pharmacy from which it came, for reprocessing.

Reprocessing of the spent pig is preferably done by the process described and claimed in the Prior Prosser Patent. This process results in a pig decontaminated to a level of cleanliness which is acceptable for most applications.

However, a significantly higher level of cleanliness is required for use in ultra clean areas.

A known approach to improving the cleanliness of the reprocessed pigs is to place the syringe or vial in a protective plastic insert within the internal cavity of the pig. See, for example, the article entitled The Incidence of Blood Contamination of Lead Unit Dose Containers With and Without Single-Use Protective Inserts Used with Commercially Prepared Radiopharmaceutical Unit Doses, by Martha W. Pickett, Judith E. Kosegi, Kathleen S. Thomas and Kristen M. Water-stram-Rich, Journal of Nuclear Medicine Technology, Volume 26, Number 3, September 1998, pages 200-203.

However, this approach, while improving cleanliness, does not provide as high a level of cleanliness as is desirable for use in ultra clean areas.

Accordingly, an object of the present invention is to provide an improved process for cleaning radiopharmaceutical pigs that is better suited for use in ultra clean areas.

SUMMARY OF THE INVENTION

As described herein, a process is provided for further cleaning a radiopharmaceutical reusable pig after it has been cleaned by the process of the Prior Prosser Patent, by transporting the cleaned pig to a drug preparation area suitable for dispensing a drug for human use, and within the drug preparation area, inserting a syringe or vial containing a radioactive drug into the containment enclosure, after which the cap is assembled to the lower portion of the pig. Then, still within the drug preparation area, the assembled pig containing the drug is placed in a protective outer container to protect the pig from external contamination during handling and transportation. The protective outer container containing the pig is then placed in a transportation receptacle.

IN THE DRAWING

The FIGURE is a diagram showing the steps in a preferred embodiment of the process of the invention.

DETAILED DESCRIPTION

Referring to the FIGURE, a spent pig containing used syringes and vials is returned to the pharmacy. At Step 1 the pig is processed according to the Prior Prosser Patent to reduce any radiation from it to background level and to remove contaminants and microorganisms.

At Step 2 the cleaned, radiation-free pig is transported to a drug preparation area suitable for dispensing a drug for human use. Such an area is usually a clean room with filtered air, or a laminar flow hood.

At Step 3, the already sanitized pig may be sanitized a second time while it is in the drug preparation area. Sanitization may be accomplished by placing the pig in an autoclave, high temperature wash, a chemical wash, or by any other suitable method that will destroy microorganisms. This step may be omitted if the resulting slightly lower level of cleanliness is acceptable for the place of use. For example, a nuclear medicine department in a hospital might not require the level of cleanliness that the operating room requires.

At Step 4 while still in the drug preparation area, a syringe or vial containing a radioactive drug to be utilized at a treatment site, including a site that requires a higher level of cleanliness such as an operating room, surgical suite, or interventional procedure suite, is inserted into the lower portion of the pig and the pig cap is assembled to the lower portion thereof.

At Step 5, while still in the drug preparation area, the assembled pig containing the drug syringe or vial is placed in a protective outer cover to protect the pig from external contamination during transportation.

The protective outer cover is preferably a self sealing pre-sterilized sterility maintenance cover or bag which is intended to cover wrapped or enclosed items after sterilization to provide protection from environmental factors which could compromise sterility. A suitable Sterility Maintenance Cover is made of a medical grade polyolefin material such as polyethylene and is commercially available from General Econopak, Inc., 1725 North Sixth Street, Philadelphia, Pa. 19122 under Reorder No. 3315ST.

At Step 6 the protective outer container containing the pig and drug syringe or vial is placed in a federal Department of Transportation approved transportation receptacle for delivery to the place where the drug is to be used.

At the destination, the protective outer container (still containing the pig and drug syringe or vial within the pig) is removed from the transportation receptacle and delivered to a utilization site which may be an operating room, surgical suite or interventional procedure room, or other area designated as a clean environment. While in that area, the outer container is removed, the cap is removed from the pig, and the syringe or vial is removed and utilized. Therefore the syringe or vial is, at all times that it is associated with the pig, kept in a protected clean environment.

For an even higher level of protection, the protective outer container can be sanitized at the site of use prior to the user touching it. Then the pig can be removed from the outer container, to expose the ultra clean pig.

I claim:

1. In a process for cleaning a radiopharmaceutical reusable pig having a lower portion, a cap, and a syringe or vial containment enclosure, comprising the steps of:

scanning the pig with a radiation detection device to detect the presence of radioactivity at a radiation level above background level;

upon detecting the presence of radioactivity at said radiation level, causing said pig to cease exhibiting said radioactivity; and sanitizing the pig to destroy any microorganisms and remove any blood contamination from said pig;

the improvement comprising the additional steps of:

transporting the ceased exhibiting radioactivity and sanitized pig to a drug preparation area suitable for dispensing a drug for human use;

within the drug preparation area, inserting a syringe or vial containing a radioactive drug into the containment enclosure and assembling the cap to the lower portion of the pig;

within the drug preparation area, placing the assembled pig containing the drug, in a protective outer container to protect the pig from external contamination during handling and transportation; and placing the protective outer container containing the pig, in a transportation receptacle.

2. The improvement according to claim 1, comprising the additional step of sterilizing or sanitizing the pig after said pig is in the drug preparation area and prior to inserting a syringe or vial into the containment enclosure thereof.

3. The improvement according to claim 1, comprising the additional step of sterilizing or sanitizing the protective outer container before the pig is placed within it.

4. In a process for cleaning a radiopharmaceutical reusable pig having a lower portion, a cap, and a syringe or vial containment enclosure, comprising the steps of:

scanning the pig to detect the presence of radio-activity at a radiation level above background level;

upon detecting the presence of radioactivity at said radiation level, causing said pig to cease exhibiting said radioactivity; and sanitizing the pig to destroy any microorganisms and remove any blood contamination from said pig;

the improvement comprising the additional steps of:

transporting the ceased exhibiting radioactivity and sanitized pig to a drug preparation area suitable for dispensing a drug for human use;

sterilizing or sanitizing the pig after said pig is in the drug preparation area;

within the drug preparation area, inserting a syringe or vial containing a radioactive drug into the containment enclosure and assembling the cap to the lower portion of the pig;

within the drug preparation area, sterilizing a protective outer container for the pig;

within the drug preparation area, placing the assembled pig containing the drug, in the protective outer container to protect the pig from external contamination during handling and transportation; and placing the protective outer container containing the pig, in a transportation receptacle.

5. The improvement according to claim 4, comprising the additional steps of:

delivering the transportation receptacle to a drug utilization facility;

at said facility, removing the outer container from the transportation receptacle;

delivering the removed outer container to a drug utilization area within the facility; and within the drug utilization area, sterilizing the protective outer container before removing the pig from the container.

* * * * *